US009157624B2

(12) United States Patent
Nourbakhsh et al.

(10) Patent No.: US 9,157,624 B2
(45) Date of Patent: Oct. 13, 2015

(54) MODULAR LED BULB WITH USER REPLACEABLE COMPONENTS

(71) Applicants: Farhad Nourbakhsh, Apple Valley, MN (US); Newton Guillen, Plymouth, MN (US)

(72) Inventors: Farhad Nourbakhsh, Apple Valley, MN (US); Newton Guillen, Plymouth, MN (US)

(73) Assignee: BBY Solutions, Inc., Richfield, MN (US)

( * ) Notice: Subject to any disclaimer, the term of this patent is extended or adjusted under 35 U.S.C. 154(b) by 32 days.

(21) Appl. No.: 13/802,943

(22) Filed: Mar. 14, 2013

(65) Prior Publication Data

US 2014/0265836 A1 Sep. 18, 2014

(51) Int. Cl.

| | |
|---|---|
| ***F21V 23/00*** | (2015.01) |
| ***F21V 23/06*** | (2006.01) |
| ***F21K 99/00*** | (2010.01) |

(52) U.S. Cl.

CPC ..... *F21V 23/06* (2013.01); *F21K 9/1355* (2013.01); *Y10T 29/49002* (2015.01)

(58) Field of Classification Search

CPC ..... H05K 1/00; H05K 1/142; H05K 2201/10106; H05K 3/36; H05K 2201/10666; F21V 23/06; F21S 4/003

USPC ..... 362/219, 217.17; 313/318.01

See application file for complete search history.

(56) References Cited

U.S. PATENT DOCUMENTS

| | | | | |
|---|---|---|---|---|
| 3,976,922 | A | 8/1976 | Peck | |
| 4,816,977 | A | 3/1989 | Sorensen | |
| 5,465,025 | A | 11/1995 | Hendrickson | |
| 6,585,393 | B1 | 7/2003 | Brandes | |
| 6,970,072 | B1 | 11/2005 | Cregg | |
| 7,345,998 | B2 | 3/2008 | Cregg | |
| 7,976,211 | B2 | 7/2011 | Cao | |
| 8,081,649 | B2 | 12/2011 | Cregg | |
| 8,115,375 | B1 | 2/2012 | Zhai | |
| 8,226,270 | B2 | 7/2012 | Yamamoto | |
| 8,232,745 | B2 | 7/2012 | Chemel | |
| 2006/0210278 | A1 | 9/2006 | Cregg | |
| 2010/0002451 | A1* | 1/2010 | Reynolds | 362/363 |
| 2010/0124054 | A1 | 5/2010 | Chen | |
| 2011/0095687 | A1* | 4/2011 | Jonsson | 315/51 |
| 2011/0285526 | A1 | 11/2011 | Tanaka | |
| 2012/0161625 | A1 | 6/2012 | Lee | |
| 2012/0300453 | A1 | 11/2012 | Zhou | |
| 2012/0326589 | A1 | 12/2012 | Yu | |
| 2013/0003346 | A1 | 1/2013 | Letoquin | |

(Continued)

OTHER PUBLICATIONS

X10, SocketRockets, http://www.x10.com/products/x10_1m15a.htm, p. 1-3, pub. Oct. 25, 2012.

*Primary Examiner* — Tracie Y Green

(74) *Attorney, Agent, or Firm* — Beck Tysver Evans PLLC

(57) ABSTRACT

A modular LED light bulb is presented. The bulb comprises a bulb envelope and a removable screw base. A power supply within the bulb envelope connects to an electrolytic capacitor within the screw base. When the electrolytic capacitor in the screw base requires replacement, the screw base is detached from the bulb envelope, the depleted electrolytic capacitor is discarded, and a new electrolytic capacitor is connected to the power supply. The various embodiments increase the useful life of the LED light bulb. In another aspect, the screw base may be adapted to accept swappable modules to provide the light bulb with additional functionality. The swappable modules may provide the light bulb with wireless control and motion sensing.

19 Claims, 4 Drawing Sheets

(56) References Cited

U.S. PATENT DOCUMENTS

2013/0010465 A1 1/2013 Wang
2013/0278132 A1* 10/2013 Yuan et al. ..... 313/46
2014/0009936 A1* 1/2014 Hata et al. ..... 362/235
2014/0056001 A1* 2/2014 Hsu et al. ..... 362/249.02
2014/0070703 A1* 3/2014 Chen et al. ..... 315/113
2014/0078723 A1* 3/2014 Chen et al. ..... 362/184

* cited by examiner

MODULAR LED BULB WITH USER REPLACEABLE COMPONENTS

FIELD OF THE INVENTION

The present application relates to the field of modular LED light bulbs. More particularly, the described embodiments relate to an LED light bulb having a detachable socket portion containing user-replaceable components.

BACKGROUND

A light-emitting diode (LED) light bulb has one or more light-emitting diodes mounted on a printed circuit board housed inside a bulb envelope. A standard LED light bulb also includes a power supply, a heat sink, and electrical insulators to isolate the electrical components. The LEDs on the circuit board have a very long life, and the life of the LED bulb is restricted mainly by the life of the electrical components other than the LEDs. Electrolytic capacitors have a relatively short life span compared to other bulb components. If the bulb is constructed of high-quality parts rated for long life, the electrolytic capacitor in the power supply is generally one of the first components to fail.

SUMMARY

One embodiment of the present invention provides a light-emitting diode (LED) light bulb having a modular socket portion. The socket portion of the bulb is removable from the bulb envelope. A power supply for the LED bulb is housed within the bulb envelope and a replaceable electrolytic capacitor for the power supply is housed within the socket portion.

DETAILED DESCRIPTION

Figure 1:
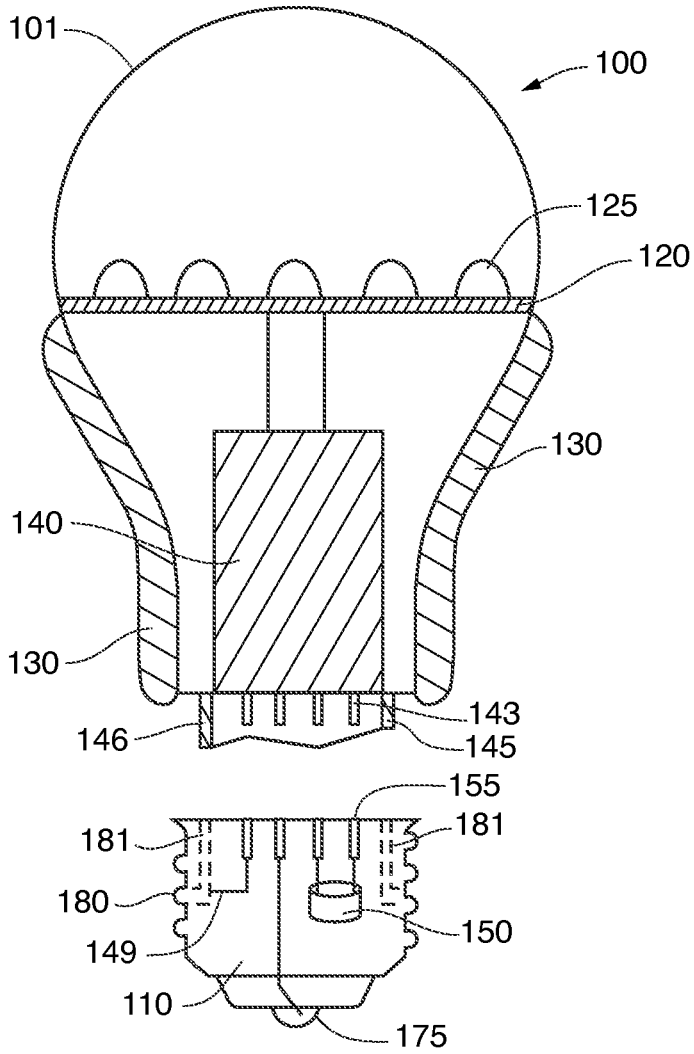
FIG. 1 is a schematic diagram of an LED light bulb with a modular socket.

FIG. 1 shows a schematic diagram of an embodiment of the LED light bulb. A light bulb housing 100 includes a bulb envelope 101 that encloses and protects internal bulb components. A heat sink 130 annularly surrounds a portion of the bulb envelope 101 and provides heat dissipation to draw heat away from the electrical components of the LED bulb. The heat sink 130 could be designed and implemented in many different ways that will be readily apparent to one skilled in the art.

A printed circuit board 120 within bulb housing 100 contains one or more LEDs 125. For example, an LED light bulb may have five LEDs 125 arranged on the printed circuit board 120. A power supply 140 within bulb housing 100 powers the circuit board 120.

A removable screw base 110 of the LED light bulb can be separated from bulb housing 100. FIG. 1 shows the base 110 detached from the bulb housing 100. In the preferred embodiment, base 110 is a standard threaded A19-type socket connector that is compatible with most consumer household lighting fixtures. In one embodiment, the entire base 110 is removable and replaceable, which eliminates the need to replace the individual components within the screw base 110. In another embodiment, the shell of the base 110 is reusable and the components within base 110 are removable and replaceable. In the preferred embodiment, the electronic components housed within bulb housing 100 are rated for long life, and will outlive the replaceable components within base 110.

The screw base 110 of FIG. 1 holds one or more removable and replaceable electrolytic capacitors 150. The base 110 may contain a single capacitor 150, or as many as four smaller capacitors 150. The capacitor 150 can be removed and replaced with a new capacitor 150 when the capacitor 150 is depleted. In a preferred embodiment, the entire base 110 may be discarded and replaced with a new base 110 having a new capacitor 150. In an alternative embodiment, the capacitor 150 may be removed from base 110 and a new capacitor placed inside base 110. The capacitor 150 could also be housed in a disposable and replaceable insulated module. Because the capacitor 150 is likely to fail before components 120, 125, 140, the described embodiments will increase the overall life of the LED light bulb.

Power supply 140 has connectors 143 that electrically connect and disconnect with connectors 155 in base 110. Electrolytic capacitor 150 connects to power supply 140 when the bulb housing 100 and screw base 110 are assembled. Power supply 140 is also electrically connected to the bottom tip 175 of base 110 via connectors 143, 155, and to the side of base 110 via a wire 149.

In one embodiment, a protective sheath 145 protrudes from housing 100 and is insertable into the base 110. When the LED bulb is assembled, the sheath 145 slides inside the base 100 and is secured with a friction fit along the inside surface 181 of base 110. Additionally, an end portion 146 may be provided. The wire 149 may extend through the end portion 146 to provide the electrical connection between power supply 140 and the side of the base 110.

To detach the screw base 110 from the bulb housing 100, the screw base 110 would be gently pulled away from bulb housing 100 so as to overcome the friction between sheath 145 and the inside surface 181 of screw base 110. A release button could also be provided. For example, a pin or paperclip could be inserted into a narrow passage between bulb housing 100 and base 110 to release the end portion 146 from notch 180. Other methods of securing screw base 110 to bulb housing 100 are contemplated, and would be evident to one skilled in the art.

Figure 2:
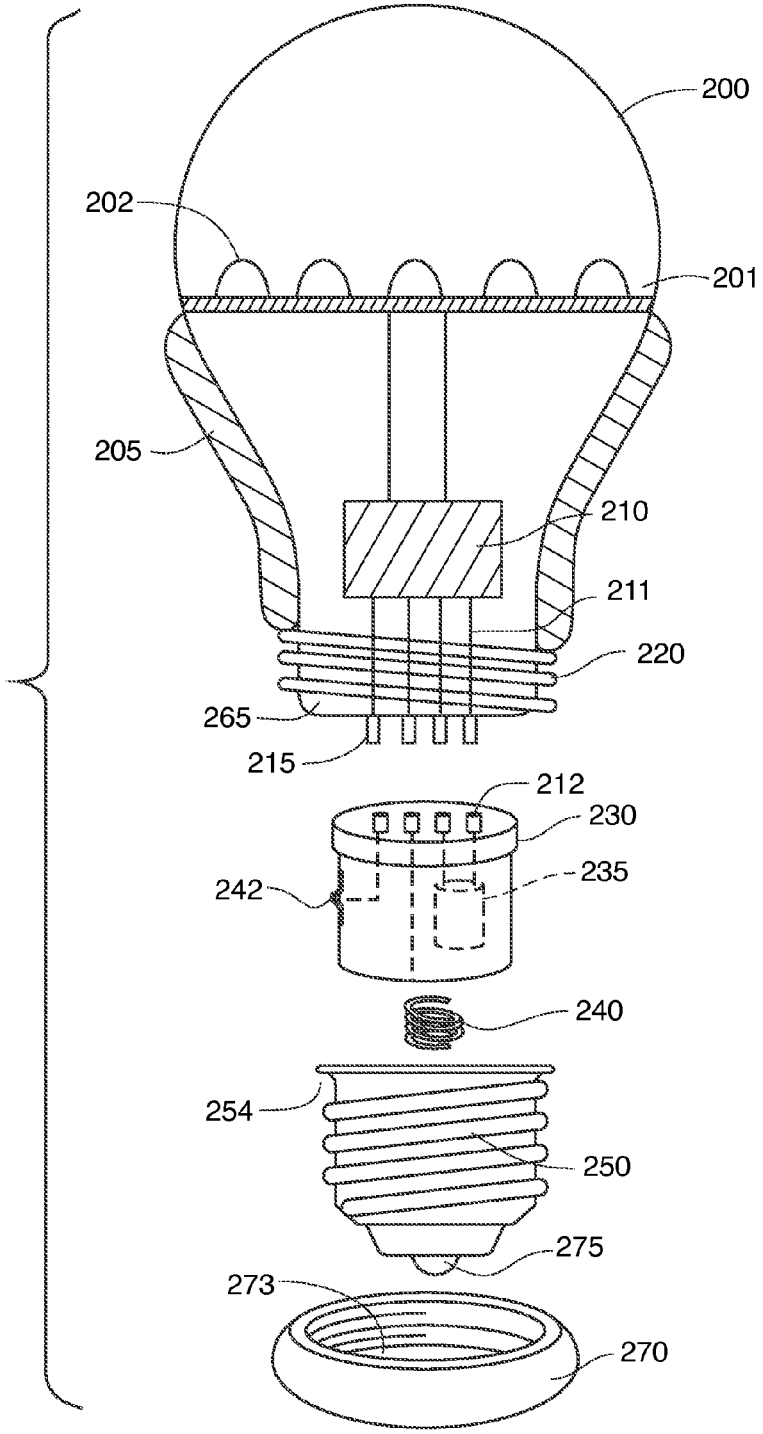
FIG. 2 is a schematic diagram showing an embodiment of the LED light bulb with an insulated electrolytic capacitor module.

FIG. 2 shows an alternative embodiment of the disclosed LED light bulb. A light bulb housing 200 holds a printed circuit board 201 containing one or more light-emitting diodes 202. A heat sink 205 for bulb housing 200 dissipates excess heat from the electronics components of circuit board 201. A power supply 210 within bulb housing 200 provides electric power to the circuit board 201. The power supply 210 is connected to electrical components in a screw base 250 via conducting wires 211 that terminate at male connectors 215.

An insulated module 230 is sized to fit inside a hollow screw base 250. In the preferred embodiment, module 230 is easily inserted and removed from screw base 250, making it simple to replace module 230. An elastic conductor such as a compression spring coil 240 is placed between the bottom 237 of module 230 and the end point 275 of screw base 250 to connect the removable module 230 to the end of screw base 250. Spring 240 could alternatively be a cantilever spring.

The module is also electrically connected to the side of screw base 250 by a spring-loaded metal pin 242.

Module 230 includes an electrolytic capacitor 235 having electrical connections that are accessible via female connector sockets 212. Module 230 is preferably made of an insulating material that protects a user from the danger of electric shock created by energy stored in capacitor 235.

Figure 3:
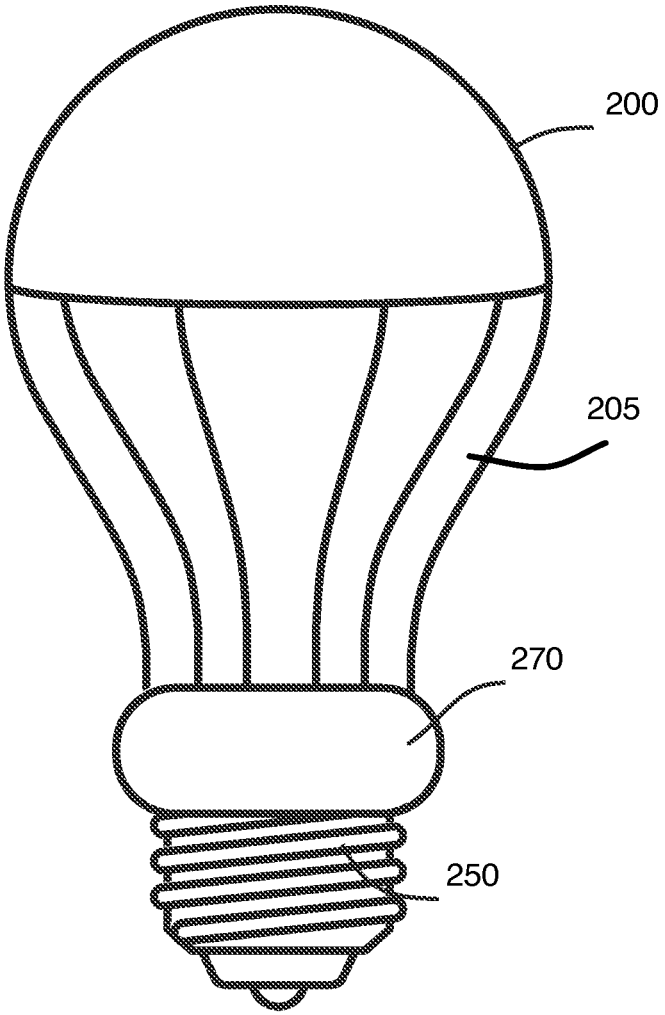
FIG. 3 is a schematic diagram of the LED light bulb of FIG. 2 in a coupled configuration.

In the embodiment of FIG. 2, screw base 250 is secured to bulb housing 200 by an annular, hollow cap 270. The module 230 is placed inside of screw base 250, and the male connectors 215 of the power supply are inserted into the female connectors 212 of the module 230. Mechanical means as known in the prior art can be included on the module 230 and housing 200 to ensure proper alignment between the connectors 212, 215. A lip 254 extends annularly outward from the top of the base 250. When bulb housing 200 and screw base 250 are attached, the annular lip 254 abuts the bottom edge 265 of bulb housing 200. The bulb housing 200 has an outside surface with threads 220 that fit threads 273 on the interior of screw cap 270. The threads 273 of cap 270 fit over the base 250. This allows cap 270 to secure the screw base 250 to the bulb housing 200 when cap 270 is fastened onto bulb housing 200 by twisting threads 220 to threads 273. FIG. 3 shows the embodiment of FIG. 2 with base 250 coupled with bulb housing 200 and secured by cap 270.

In an alternative embodiment, module 230 could hold electronic components other than an electrolytic capacitor. For example, module 230 could be a "swappable" module to provide the LED bulb with additional functionalities. For example, the module could include a transformer to convert voltage from 220 volts to 120 volts. Module 230 could also provide secondary circuitry to add additional functionality to the LED light bulb, such as wireless control and motion sensing. A wireless receiver such as a Wi-Fi receiver, an infrared receiver, or a radio frequency receiver could be inserted into the screw base to wirelessly receive control signals from a wireless remote control. For example, a remote control could send on/off instructions, dimming instructions, or timing control instructions to set the bulb to turn on or off at predetermined time intervals. A motion sensing module could provide motion control such as on/off functionality when motion is detected/not detected by the motion sensor. A wide variety of swappable modules could be provided to users to make the LED bulb customizable for many different uses. These component modules may be provided in the module 230 addition to the capacitor described above.

Figure 4:
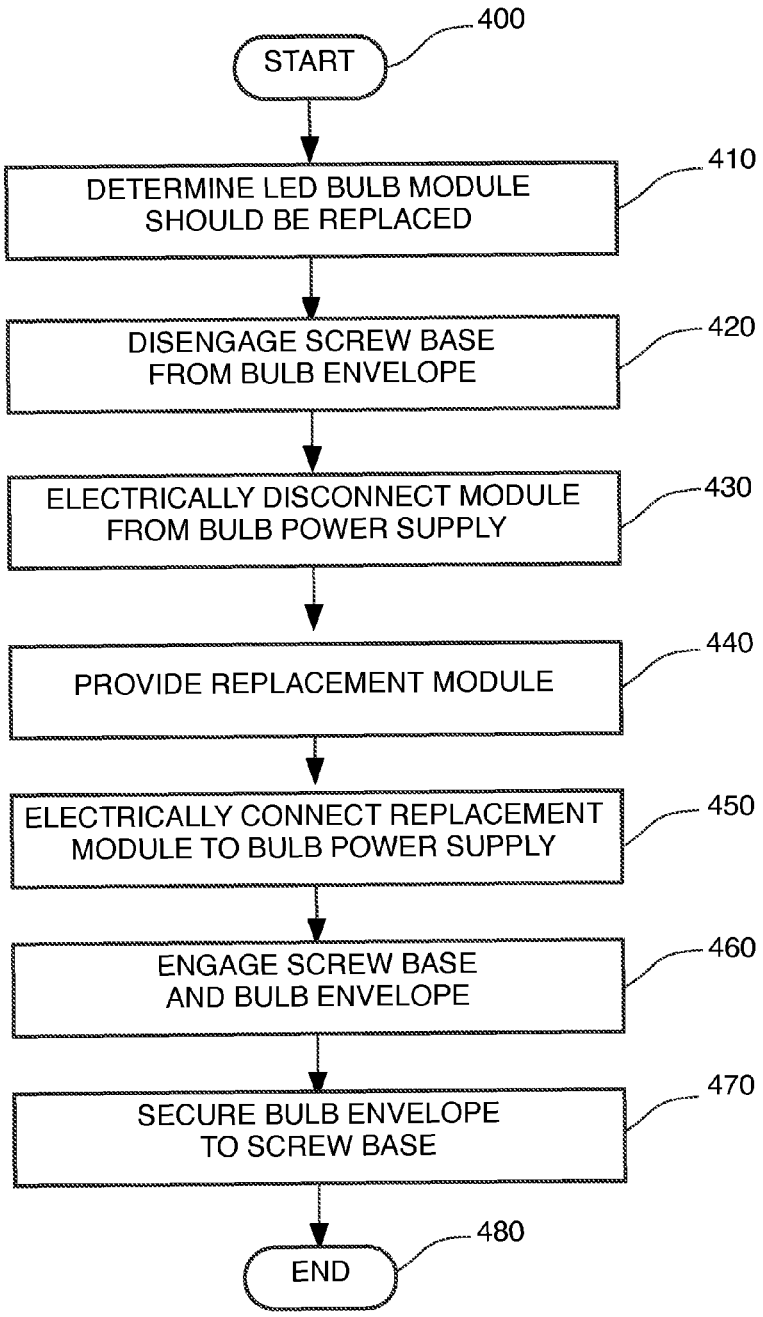
FIG. 4 is a flow chart demonstrating a method of replacing a component in a modular light bulb.

FIG. 4 is a flow chart demonstrating a method 400 for replacing components in a modular bulb. The method may be used with the LED light bulb as shown in FIGS. 1-3. In step 410 of the method a user determines that components of the LED light bulb should be replaced. The determination may be made if the LED light bulb appears dimmer than normal. The light bulb may also flicker when connected to a power source, or be entirely unable to illuminate. These and other indicators can show that the electrolytic capacitor of the bulb power supply has degraded and no longer functions adequately. The determination may also be made at a set time interval. For example, a manufacturer could recommend that the electrolytic capacitor module should be replaced after a certain number of hours, months, or years of light bulb use.

Alternatively, in an embodiment utilizing swappable modules such as wireless control or motion sensing modules, in step 410 a user could decide to swap a first module having a first electronic component (e.g., a Wi-Fi remote control module) with a second module having a second electronic component (e.g., a motion sensing module) to change or add functionality of the LED light bulb.

In step 420, the screw base is disconnected from the bulb envelope. In FIG. 1, this step would be accomplished by pulling the screw base 110 away from bulb housing 100 with sufficient force to overcome the friction between sheath 145 and the inside surface 181 of screw base 110. In FIG. 2, cap 270 would be unthreaded from threads 220 of bulb housing 200, and the lip 254 of screw base 250 would be disengaged from the bottom edge 265 of bulb housing 200.

In step 430, the degraded electrolytic capacitor 150 or 235 is electrically disconnected from power supply 140 or 210 respectively. In step 440, a new electrolytic capacitor 150 or 235 is provided. In the embodiment of FIG. 2, the electrolytic capacitor 235 is provided inside of module 230. In the embodiment of FIG. 1 in which the entire screw base is 110 is removed and replaced, the electrolytic capacitor is provided inside of a new replacement screw base 110. Because of the danger of electric shock, preferably the user does not need to extract the electrolytic capacitor from the replaceable module 230 or screw base 110.

In step 450, the replacement capacitor 150 or 235 is electrically connected to the bulb power supply 140 or 210. In FIG. 1, this is accomplished by engaging power supply connectors 143 with capacitor connectors 155. In the embodiment of FIG. 2, the male power supply connectors 215 would be inserted into the female sockets 212 of module 230.

In the embodiment utilizing swappable modules, steps 430-450 would include disconnecting the first module from the internal components of the LED light bulb and replacing the first module with the second module in the screw base 110 or 250.

In step 460, the screw base 110 or 250 is engaged with the bulb housing 100 or 200. In step 470 the bulb housing 100, 200 and screw base 110, 250 are again secured together by sheath 145 or cap 270. The method ends at step 480.

The many features and advantages of the invention are apparent from the above description. Numerous modifications and variations will readily occur to those skilled in the art. For example, a single screw base could contain more than one replaceable module. Since such modifications are possible, the invention is not to be limited to the exact construction and operation illustrated and described. Rather, the present invention should be limited only by the following claims.

What is claimed is:

1. A modular light bulb comprising:

a) a light bulb housing, the housing containing
   i) a circuit board having light-emitting diodes,
   ii) a power supply, and
   iii) a housing capacitor connector connected to the power supply;

b) a first removable base, the base containing
   i) an electrolytic capacitor, and
   ii) a base capacitor connector connected to the electrolytic capacitor; and c) a bulb coupler to removably attach the light bulb housing to the first removable base while connecting the housing capacitor connector in the bulb housing to the base capacitor connector in the first removable base.

2. The modular light bulb of claim 1, wherein the bulb housing includes a bulb envelope.

3. The modular light bulb of claim 1, wherein the first removable base comprises an external thread to fit a light bulb socket.

4. The modular light bulb of claim 3, wherein the first removable base is an A19-type base.

5. The modular bulb of claim 1, wherein the electrolytic capacitor is removable from the first removable base.

6. The modular light bulb of claim 5, wherein the electrolytic capacitor is housed inside an insulating module.

7. The modular light bulb of claim 6, wherein the housing capacitor connector is a male connector and the base capacitor connector is a female connector compatible with the male connector.

8. The modular light bulb of claim 1, wherein the bulb coupler is a sheath connected to the bulb housing, the sheath having a friction fit with an inside surface of the first removable base to removably secure the first removable base to the bulb housing.

9. The modular light bulb of claim 1, wherein the bulb coupler is an annular, hollow cap.

10. The modular light bulb of claim 1, wherein the bulb housing further comprises a heat sink.

11. The modular light bulb of claim 1 wherein the first removable base further comprises a wireless receiver for wireless control of the light emitting diodes.

12. The modular light bulb of claim 1, further comprising a second removable based comprising a motion sensor for motion control of the light-emitting diodes, wherein the second removable base may be attached through the bulb coupler to the light bulb housing after the first removable base is removed from the bulb coupler.

13. A modular LED light bulb comprising:

a) a light bulb housing having:

i) a light bulb envelope forming an upper exterior of the light bulb housing, ii) a heat sink attached to the light bulb envelope and forming a lower exterior of the light bulb housing, iii) a plurality of LEDs located in an interior of the light bulb housing, iv) a power supply to provide power to the LEDs, the power supply being located in the interior of the light bulb housing, v) housing power connectors located proximal to a lower end of the light bulb housing, the housing power connectors in electrical communication with the power supply to provide electrical current to the power supply;

vi) housing capacitor connectors located proximal to the lower end of the light bulb housing, the housing capacitor connectors in electrical communication with the power supply to allow access to an external capacitor;

b) a removable base portion that is removably attached to the light bulb housing, the removable base portion having:

i) a capacitor for use by the power supply as the external capacitor;

ii) an electrically conductive exterior portion providing access to electrical current;

iii) base power connectors located proximal to an upper end of the base portion, the base power connectors in electrical communication with the electrically conductive exterior;

iv) base capacitor connectors located proximal to the upper end of the base portion, the base capacitor connectors in electrical communication with the capacitor;

wherein when the removable base portion is attached to the light bulb housing, the base power connectors are in electrical communication with the housing power connectors and the base capacitor connectors are in electrical communication with the housing capacitor connectors.

14. The module LED light bulb of claim 13, wherein the capacitor is an electrolytic capacitor.

15. The modular LED light bulb of claim 13, wherein the electrically conductive exterior portion comprises a threaded light bulb base.

16. The modular LED light bulb of claim 15, wherein the threaded light bulb base conforms to the A-19 socket connector standard.

17. The modular LED light bulb of claim 13, further comprising a sheath attached to the lower end of the light bulb housing that interacts with an interior surface of the removable base portion to hold the light bulb housing to the removable base portion together through a friction fit.

18. The modular LED light bulb of claim 13, wherein the removable base portion comprises an insulating module and a screw base, further wherein the insulating module contains the capacitor, the base power connectors, and the base capacitor connectors; and the screw base comprises the electrically conductive exterior; and further wherein two electrical connectors in the insulating modules connect the electrically conductive exterior portion of the screw base to the base power connectors.

19. The modular LED light bulb of claim 18, wherein the removable module further comprises electronic sensors that control the action of the LEDs.

* * * * *